US012808087B2

(12) United States Patent
Ramsey et al.

(10) Patent No.: US 12,808,087 B2
(45) Date of Patent: Nov. 24, 2026

(54) LINT CLEANER SAW IMPROVEMENTS

(71) Applicant: Ramsey Air Management Inc., Lubbock, TX (US)

(72) Inventors: Lloyd Todd Ramsey, Lubbock, TX (US); Robert Taylor Jameson, Lubbock, TX (US); Kohle Dietmeier, Lubbock, TX (US)

( * ) Notice: Subject to any disclaimer, the term of this patent is extended or adjusted under 35 U.S.C. 154(b) by 0 days.

(21) Appl. No.: 19/172,436

(22) Filed: Apr. 7, 2025

(65) Prior Publication Data

US 2025/0341027 A1 Nov. 6, 2025

Related U.S. Application Data

(60) Provisional application No. 63/575,061, filed on Apr. 5, 2024.

(51) Int. Cl.
*D01B 1/04* (2006.01)

(52) U.S. Cl.
CPC ..... *D01B 1/04* (2013.01)

(58) Field of Classification Search
CPC . D01B 1/04; D01B 1/06; B65G 39/00; B65G 39/02; B65G 39/09
USPC ..... 19/40, 41, 43, 54
See application file for complete search history.

(56) References Cited

U.S. PATENT DOCUMENTS 1,002,913 A * 9/1911 Harriss ..... D01B 1/04 492/31
1,068,156 A * 7/1913 Mullen ..... D01B 1/04 19/43
1,370,383 A * 3/1921 Tischer ..... D01B 1/04 19/54
1,709,021 A * 4/1929 Jenkins ..... D01B 1/04 19/60
1,731,534 A * 10/1929 Karrer ..... D01B 1/04 19/54
3,877,111 A 4/1975 Horn
5,412,844 A 5/1995 Horn
(Continued)

FOREIGN PATENT DOCUMENTS

CN 2550383 Y * 5/2003
CN 106697836 A * 5/2017 ..... B65G 39/02

OTHER PUBLICATIONS

Translation CN 106697836.*
Translation CN 2550383.*

*Primary Examiner* — Shaun R Hurley
(74) *Attorney, Agent, or Firm* — Shannon Warren

(57) ABSTRACT

A head assembly for use with a lint cleaner tube assembly for use in cotton gins is disclosed. Comprising the head assembly is configured for installation into a tube portion of the lint cleaner tube assembly. The lint cleaner tube assembly and the head assembly comprise a rotating axis. The tube portion having a surface wrap configured to clean lint. The head assembly comprise a first head assembly and a second head assembly which are configured to be installed into end portions of the tube portion. The head assembly comprising a slotted shaft, a keyless bushing assembly, a distal hub, a proximate hub, a splined hub. The slotted shaft having a splined portion at an interior end. The keyless bushing assembly configured to mount the slotted shaft and ensure alignment with the rotating axis. The splined hub configured to engage with the splined portion of the slotted shaft.

20 Claims, 7 Drawing Sheets

(56) References Cited

U.S. PATENT DOCUMENTS

| | | | | |
|---|---|---|---|---|
| 6,523,678 | B2 * | 2/2003 | Roessler | B65G 21/105 198/780 |
| 7,309,187 | B2 | 12/2007 | Swanson | |
| 2013/0092776 | A1 * | 4/2013 | Habib | B02C 4/08 29/895.2 |
| 2014/0069767 | A1 * | 3/2014 | Arsenenau | B65G 39/09 193/37 |
| 2024/0110312 | A1 * | 4/2024 | Jones | D01B 1/06 |

* cited by examiner

LINT CLEANER SAW IMPROVEMENTS

CROSS-REFERENCE TO RELATED APPLICATIONS

This application claims benefit to the U.S. provisional patent application 63/575,061 filed 2024 Apr. 5, which is incorporated-by-reference.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

No prior art is known to the Applicant.

BRIEF SUMMARY OF THE INVENTION

A head assembly 102 for use with a lint cleaner tube assembly 100 for use in cotton gins is disclosed. Comprising said head assembly 102 is configured for installation into a tube portion 104 of said lint cleaner tube assembly 100. Said lint cleaner tube assembly 100 and said head assembly 102 comprise a rotating axis 108. Said tube portion 104 having a surface wrap 106 configured to clean lint. Said head assembly 102 comprise a first head assembly 102*a* and a second head assembly 102*b* which are configured to be installed into end portions of said tube portion 104. Said head assembly 102 comprising a slotted shaft 200, a keyless bushing assembly 204, an distal hub 208, an proximate hub 210, a splined hub 212. Said slotted shaft 200 having a splined portion 500 at an interior end 502. Said keyless bushing assembly 204 configured to mount said slotted shaft 200 and ensure alignment with the rotating axis 108. Said splined hub 212 configured to engage with said splined portion 500 of said slotted shaft 200. Wherein the splined engagement between said splined hub 212 and said splined portion 500 of said slotted shaft 200 allows for selective attachment and detachment of said slotted shaft 200, facilitating serviceability of said lint cleaner tube assembly 100.

The head assembly 102 for the lint cleaner tube assembly 100 in cotton gins is disclosed. Comprising the slotted shaft 200 having the splined portion 500 at one end. the distal hub 208 and the proximate hub 210 connected by a shaft tube 206, aligned with the rotating axis 108. the splined hub 212 within said shaft tube 206, configured to receive and engage said splined portion 500 of said slotted shaft 200. the keyless bushing assembly 204 fitted within said distal hub 208, configured to secure said slotted shaft 200 and ensure its alignment with said rotating axis 108. Wherein the splined engagement between said splined hub 212 and said splined portion 500 of said slotted shaft 200 allows for selective removal and replacement of said slotted shaft 200, improving the serviceability of said lint cleaner tube assembly 100.

A method for servicing the lint cleaner tube assembly 100 in a cotton gin is disclosed. Comprising loosening a plurality of hub fasteners 508 of the keyless bushing assembly 204 to release the slotted shaft 200, disengaging the splined portion 500 of said slotted shaft 200 from the splined hub 212, removing said slotted shaft 200 from said head assembly among the head assembly 102, inserting a replacement slotted shaft 200 into said head assembly among said head assembly 102, engaging the splined portion 500 of said replacement slotted shaft 200 with said splined hub 212, tightening said plurality of hub fasteners 508 of said keyless bushing assembly 204 to secure said replacement slotted shaft 200 and ensure its alignment with the rotating axis 108 of said lint cleaner tube assembly 100. Wherein, said lint cleaner tube assembly 100 comprising the tube portion 104 with the surface wrap 106 and head assembly 102 each having the slotted shaft 200 with the splined portion 500, the splined hub 212, and the keyless bushing assembly 204.

DETAILED DESCRIPTION OF THE INVENTION

The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1A:
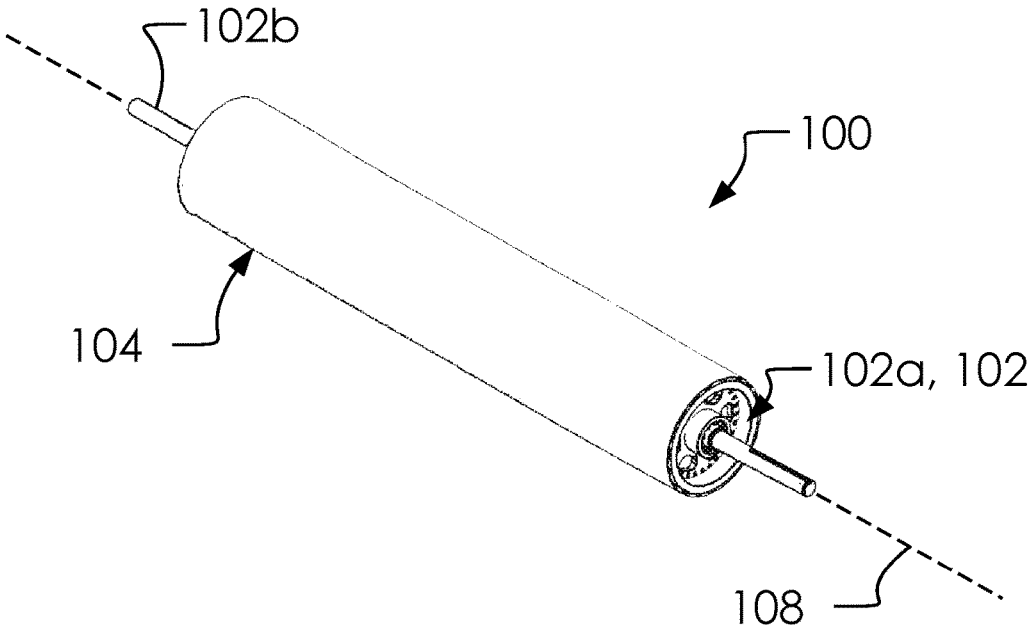
FIGS. 1A, 1B and 1C illustrate a perspective overview, an elevated top view and an elevated side view of a lint cleaner tube assembly 100.
Figure 1B:
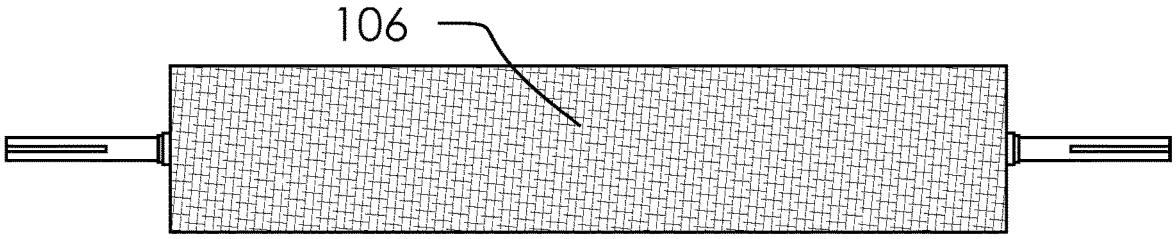
Figure 1C:
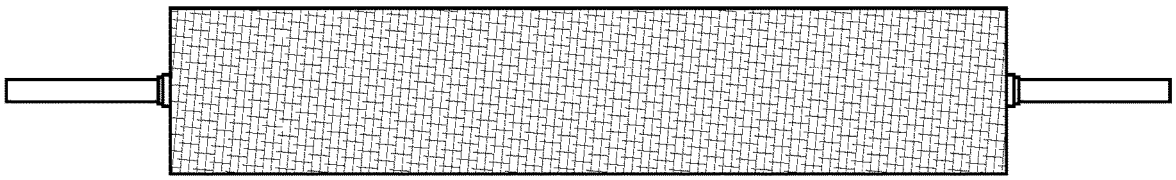

FIGS. 1A, 1B and 1C illustrate a perspective overview, an elevated top view and an elevated side view of a lint cleaner tube assembly 100.

Said lint cleaner tube assembly 100 can comprise a first head assembly 102*a* and a second head assembly 102*b*, a tube portion 104 having a surface wrap 106, and a rotating axis 108.

Said first head assembly 102*a* and said second head assembly 102*b* may also be referred to as a head assembly 102, or as a saw head assembly.

In one embodiment, said surface wrap 106 can comprise saw wire, as is known in the art.

Said head assembly 102 are configured to secure said lint cleaner tube assembly 100 to a motorized drive unit and configured to drive said lint cleaner tube assembly 100 about said rotating axis 108.

One of the challenges of said lint cleaner tube assembly 100 is that it is prone to wear and tear due to the abrasive nature of the foreign materials embedded in the lint and the high speed of rotation. Said head assembly 102, which are responsible for securing and driving said tube portion 104, may become damaged or worn out over time, affecting the performance and efficiency of said lint cleaner tube assembly 100. Additionally, said surface wrap 106, which is applied to said tube portion 104 to provide a rough texture for removing the foreign materials embedded in the fibers, may also deteriorate or peel off after prolonged use, reducing the effectiveness of the lint cleaning process.

Figure 2A:
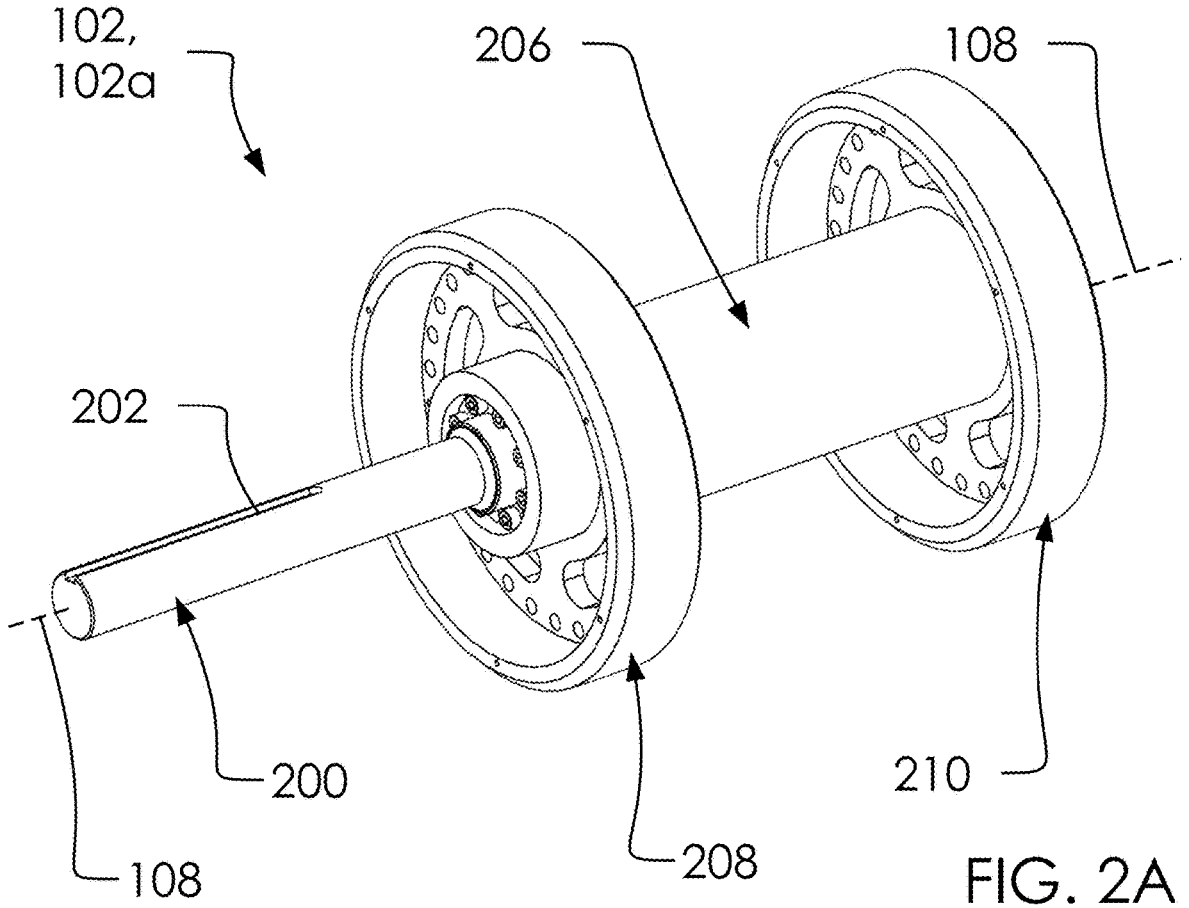
FIGS. 2A and 2B a perspective overview of a first head assembly 102*a*, and the same without a shaft tube 206.
Figure 2B:
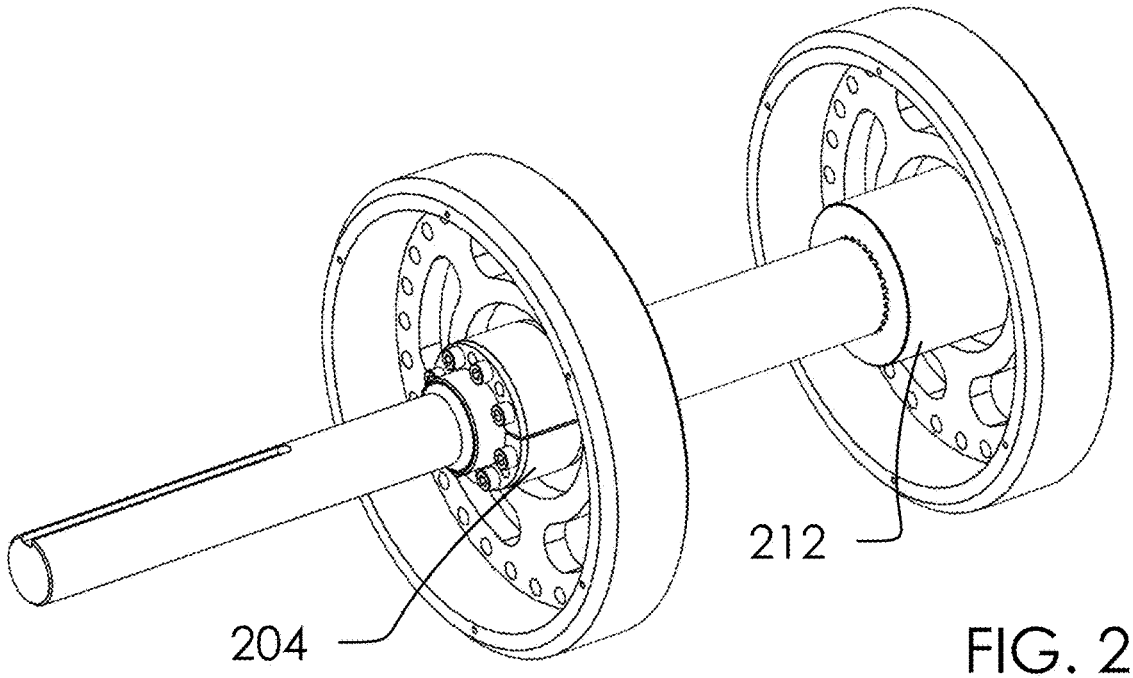

FIGS. 2A and 2B a perspective overview of said first head assembly 102*a*, and the same without a shaft tube 206.

To address these problems, said head assembly 102 provides a system and method for repairing and replacing a slotted shaft 200 in a convenient and cost-effective manner. The system and method involve having a replaceable version of said slotted shaft 200 that can be easily detached and attached to said tube portion 104 without requiring a complex procedure. The replaceable head assembly can include new or refurbished parts throughout said lint cleaner tube assembly 100, which can be pre-assembled and ready to use. By having configuring said slotted shaft 200 to be replaceable, said lint cleaner tube assembly 100 can be restored to its optimal condition without having to replace the entire unit, saving time, money, and resources.

Each among said head assembly 102 can comprise said slotted shaft 200 having a shaft slot 202, a keyless bushing assembly 204, the shaft tube 206, an distal hub 208, an proximate hub 210 and a splined hub 212.

Like said lint cleaner tube assembly 100, said head assembly 102 rotate about said rotating axis 108.

Said distal hub 208 and said proximate hub 210 can be connected to one another using a portion of said shaft tube 206 and said slotted shaft 200. As illustrated, said distal hub 208, said proximate hub 210 and said shaft tube 206 can be aligned with said rotating axis 108.

Figure 3:
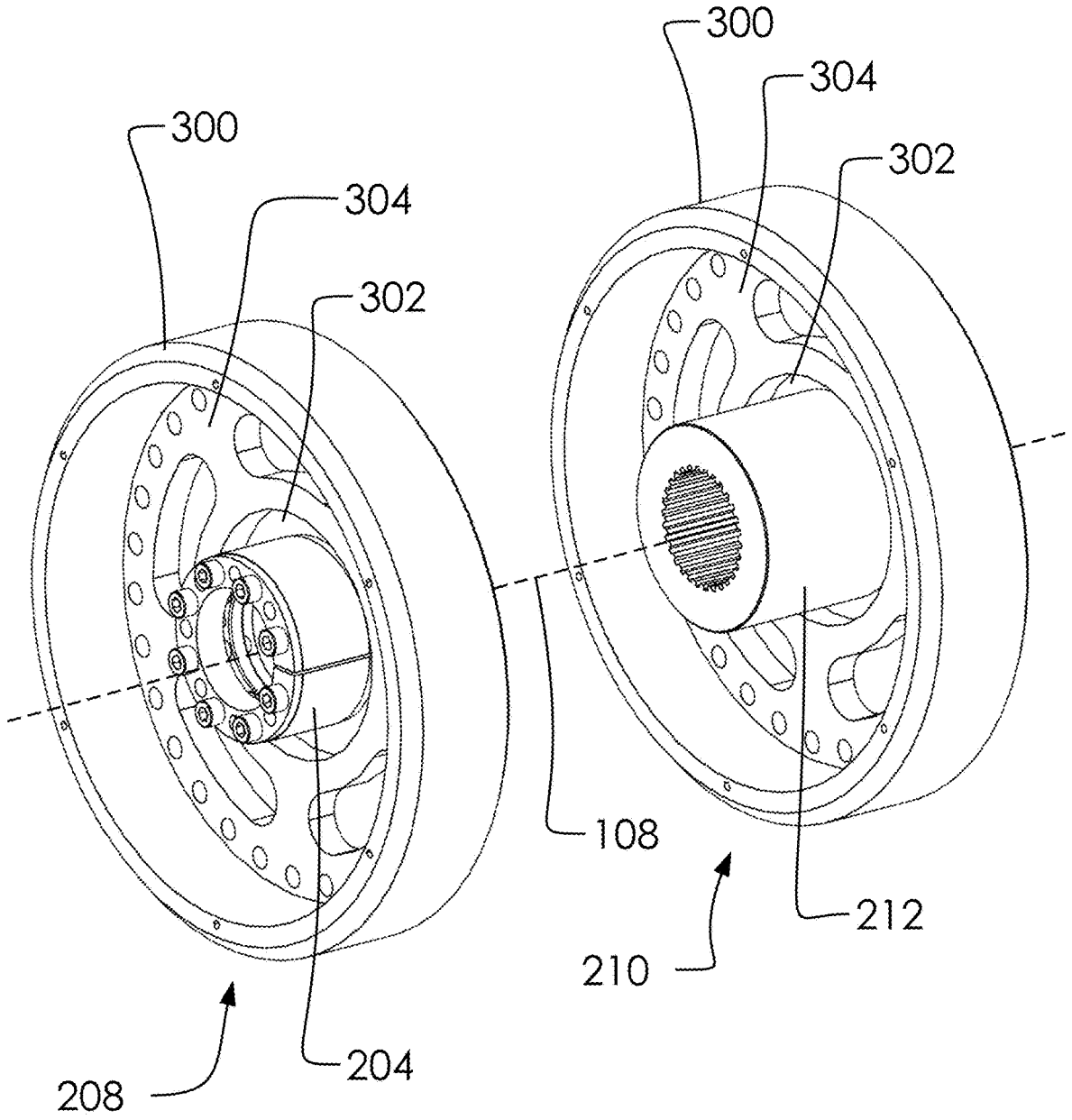
FIG. 3 an isolated perspective overview of distal hub 208 and proximate hub 210 without slotted shaft 200 and shaft tube 206.

FIG. 3 an isolated perspective overview of distal hub 208 and proximate hub 210 without slotted shaft 200 and shaft tube 206.

Each among said distal hub 208 and said proximate hub 210 can comprise a head tubing 300 and a hub plate 304, each comprising a center aperture 302 and being aligned with rotating axis 108.

In said distal hub 208, said keyless bushing assembly 204 can be fit within said center aperture 302 on distal hub 208 and said proximate hub 210, respectively.

In one embodiment, said shaft tube 206 can be arranged around distal hub 208 and splined hub 212 and within center aperture 302 of hub plate 304 of each among distal hub 208 and proximate hub 210, respectively. Accordingly, distal hub 208 and proximate hub 210 can be balanced to rotate about rotating axis 108 with the benefit of the replaceability of keyless bushing assembly 204 and the centered accuracy of splined hub 212.

Figure 4A:
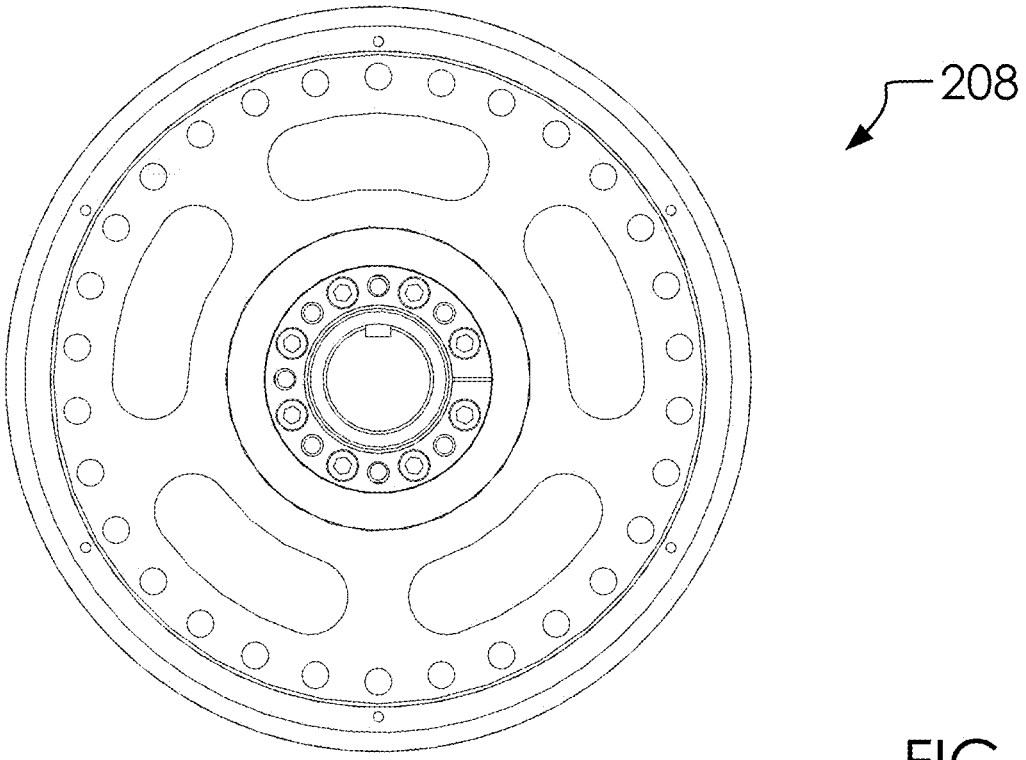
FIGS. 4A and 4B illustrate an elevated side view of said distal hub 208 and said proximate hub 210, respectively.
Figure 4B:
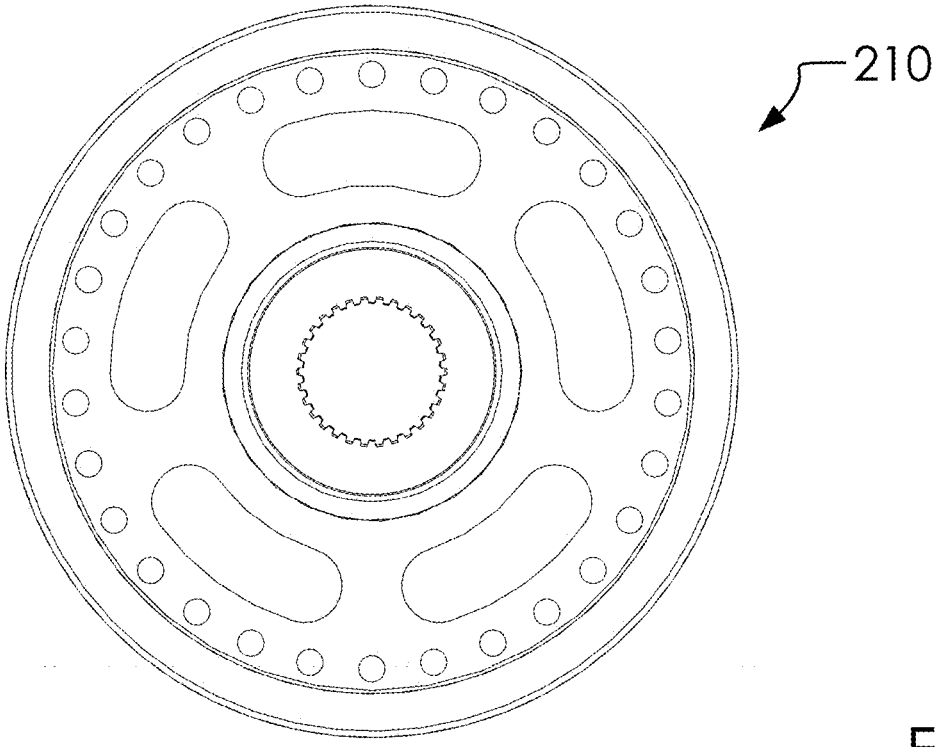

FIGS. 4A and 4B illustrate an elevated side view of said distal hub 208 and said proximate hub 210, respectively.

Figure 5A:
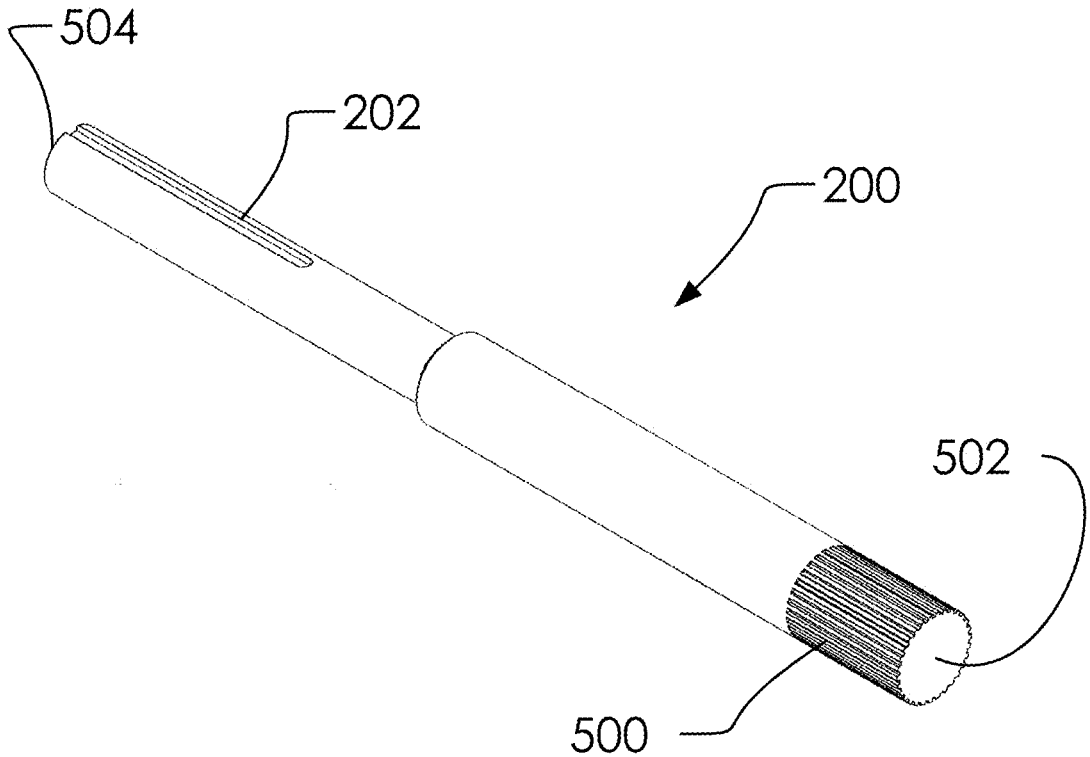
FIGS. 5A, 5B and 5C three perspective overview of said slotted shaft 200.
Figure 5B:
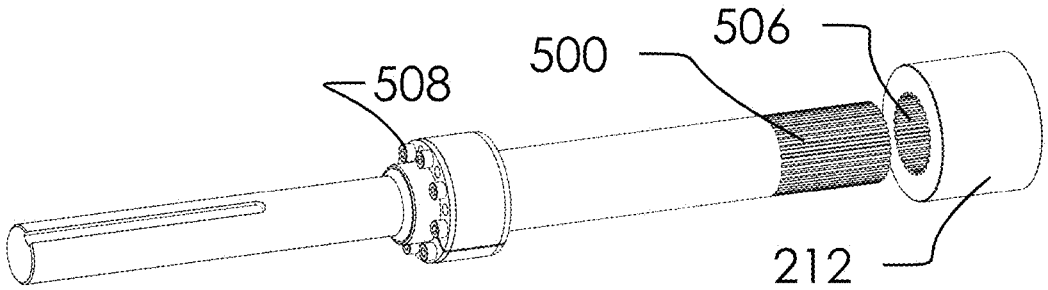
Figure 5C:
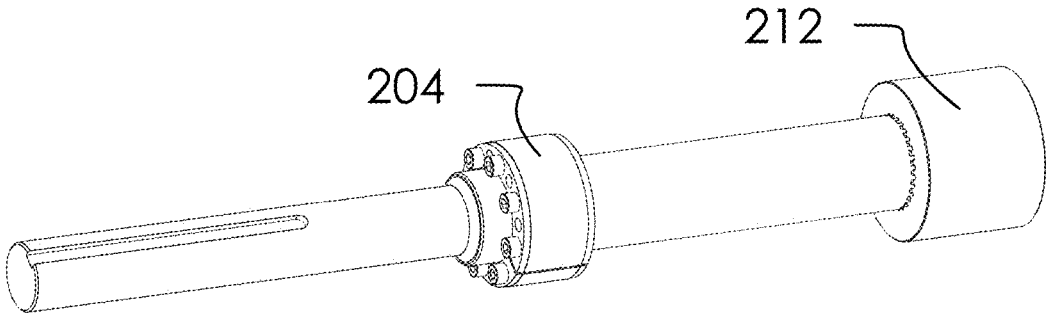

FIGS. 5A, 5B and 5C three perspective overview of said slotted shaft 200.

In one embodiment, said slotted shaft 200 can comprise a splined portion 500 at an interior end 502 and said shaft slot 202 at an exterior end 504. In one embodiment, said splined portion 500 can be in said interior end 502. Said splined hub 212 can comprise a splined socket 506; wherein, said splined portion 500 of said slotted shaft 200 can be configured to selectively slide into said splined socket 506 of said splined hub 212. Accordingly, said slotted shaft 200 can be removed from said head assembly 102 by loosening a portion of a plurality of hub fasteners 508 of said keyless bushing assembly 204, and removing slotted shaft 200 from said distal hub 208 and said proximate hub 210. Additionally, a tight fit between said splined socket 506 and said splined portion 500 can align said slotted shaft 200 with rotating axis 108 and ensure a balanced rotational movement of said head assembly 102, and said lint cleaner tube assembly 100.

Figure 6A:
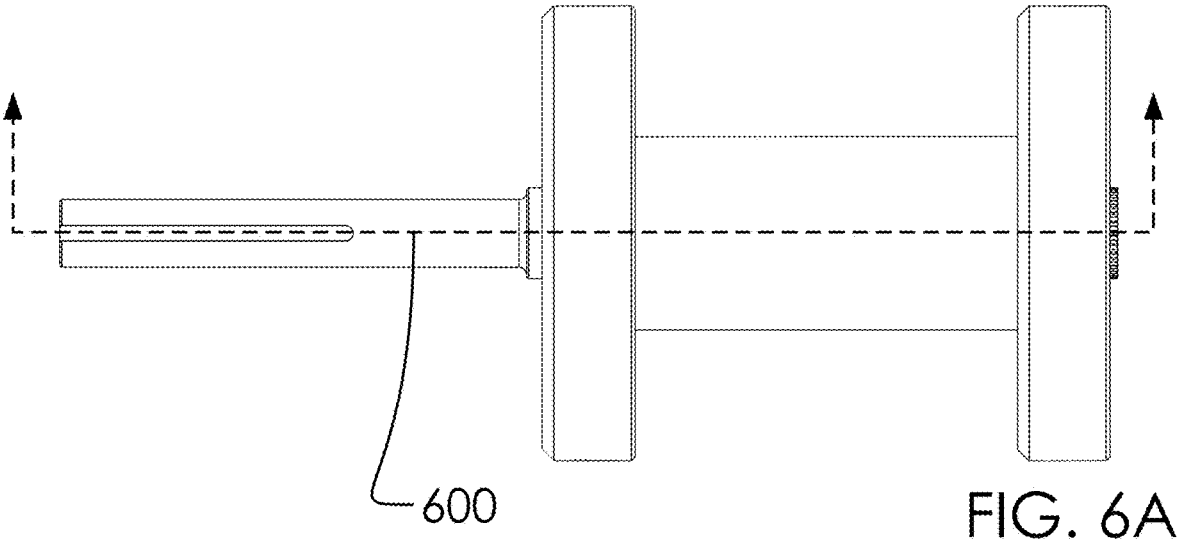
FIGS. 6A and 6B illustrate an elevated side view of said first head assembly 102*a* showing a section plate line 600, and perspective overview thereof in cross section at said section plate line 600.
Figure 6B:
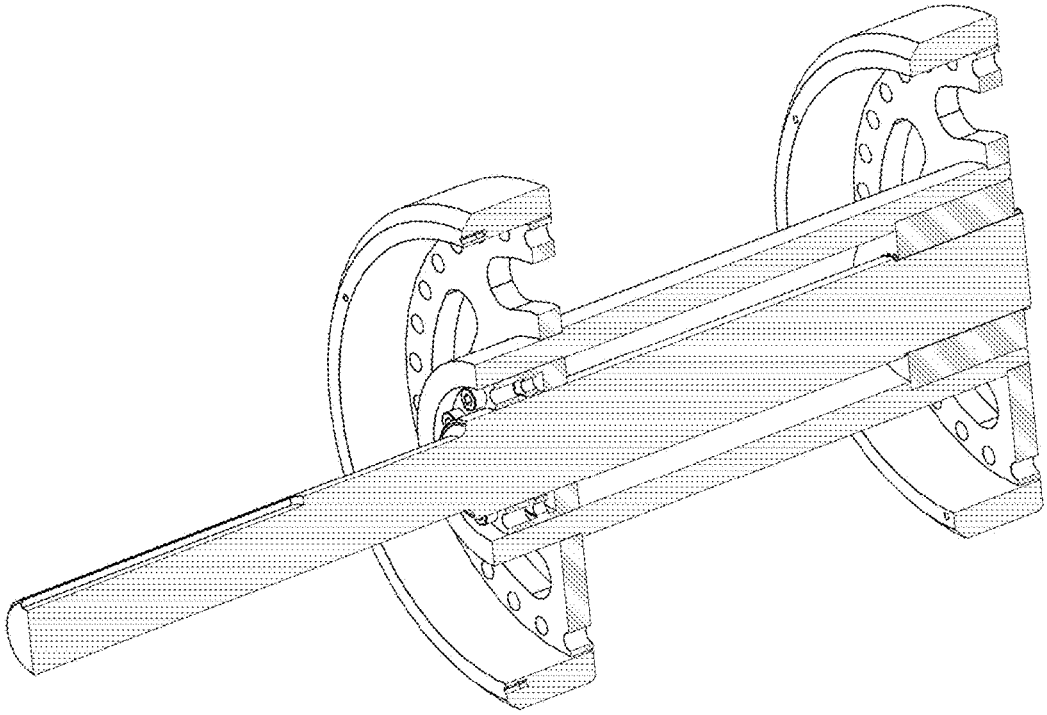

FIGS. 6A and 6B illustrate an elevated side view of said first head assembly 102*a* showing a section plate line 600, and perspective overview thereof in cross section at said section plate line 600.

With reference to FIG. 6B, note that said keyless bushing assembly 204 can be configured to center and align said head assembly 102 with reference to said rotating axis 108.

In one embodiment, said shaft tube 206 can further comprise the splined hub 212 configured to slot into said section plate line 600 of said slotted shaft 200. Wherein, said splined hub 212 can be configured to transmit maximum torque to the shaft. For example, said splined hub 212 in one embodiment can transmit 10,000 pounds of torque.

Figure 7:
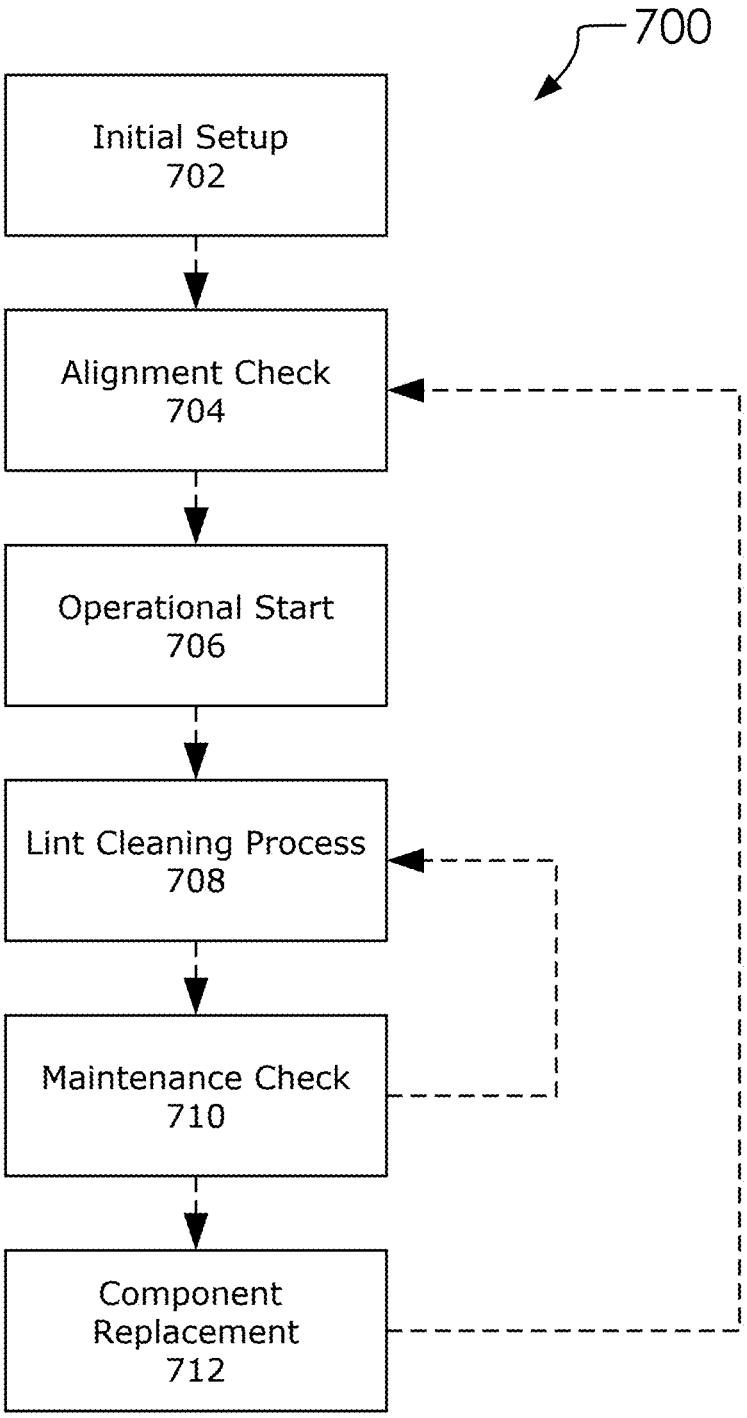
FIG. 7 illustrates a method of use 700 for said lint cleaner tube assembly 100 with a head assembly 102.

FIG. 7 illustrates a method of use 700 for said lint cleaner tube assembly 100 with said head assembly 102.

Said method of use 700 can comprise an initial setup step 702, comprising attaching said head assembly 102 to said tube portion 104 of said lint cleaner tube assembly 100. In one embodiment, said keyless bushing assembly 204 can be used to align said head assembly 102 with said rotating axis 108.

Said method of use 700 can comprise an alignment check step 704 comprising ensuring that said head assembly 102 are properly aligned along said rotating axis 108.

Said method of use 700 can comprise an operational start step 706 comprising powering up the motorized drive unit to which said lint cleaner tube assembly 100 is connected. This initiates the rotation of said tube portion 104 around said rotating axis 108.

Said method of use 700 can comprise a lint cleaning process step 708 comprising, as said tube portion 104 rotates, said surface wrap 106 effectively interacts with the cotton fibers, removing impurities and cleaning the lint. The efficiency of this process is enhanced by the stable rotation facilitated by said keyless bushing assembly 204.

Said method of use 700 can comprise a maintenance check step 710 comprising periodic maintenance checks are recommended to assess the condition of said head assembly 102 and said surface wrap 106. This step includes inspecting for wear and ensuring that all components are securely attached.

Said method of use 700 can comprise a component replacement step 712; wherein, if wear or damage is detected, particularly in said head assembly 102 or said surface wrap 106, the component replacement process is initiated. This involves detaching the worn parts, and replacing them with new or refurbished parts.

Said method of use 700 can comprise repeating said alignment check step 704 and said operational start step 706.

Wherein, after replacement, a post-maintenance alignment check is performed to ensure that the new components are properly aligned along said rotating axis 108. Further, a resumption of operation continues. Once alignment is confirmed post-maintenance, the operation of said lint cleaner tube assembly 100 can resume. The assembly is now restored to optimal condition, ready for continued efficient lint cleaning.

Having discussed the components and uses of said lint cleaner tube assembly 100 with said head assembly 102, consider the goals and benefits of the system.

One of the primary challenges faced by said lint cleaner tube assembly 100 is its susceptibility to wear and tear. This is largely due to the abrasive nature of the lint being processed and the high-speed operation of said lint cleaner tube assembly 100. Over time, this wear and tear can significantly impact the functionality and efficiency of said lint cleaner tube assembly 100. In particular, components such as said head assembly 102, which play a crucial role in securing and driving said tube portion 104, are prone to damage and deterioration. Similarly, said surface wrap 106 that is applied around said tube portion 104 for effective lint removal, may also experience wear, leading to a decrease in the effectiveness of the lint cleaning process.

In one embodiment, said keyless bushing assembly 204 can serve as a pivotal component in said lint cleaner tube assembly 100, ensuring the precise and secure mounting of said head assembly 102 onto said tube portion 104. The use of said keyless bushing assembly 204 brings several advantages, including ease of assembly, high precision in alignment, and simplified maintenance. This assembly negates the need for traditional connection methods, allowing for a more streamlined and efficient construction. Furthermore, the self-centering feature of said keyless bushing assembly 204 ensures optimal alignment, which is critical for the smooth operation and longevity of said lint cleaner tube assembly 100.

In one embodiment, said shaft tube 206 can be integral to the structural and functional integrity of said lint cleaner tube assembly 100. Comprising said distal hub 208, said proximate hub 210, and said shaft tube 206, this assembly can form the core of said head assembly 102. The connection and alignment of said distal hub 208 and said proximate hub 210 using said shaft tube 206 are pivotal for the stable operation of said lint cleaner tube assembly 100. This arrangement not only provides robust support to said tube portion 104 but also aids in the uniform distribution of torque and rotational forces along said rotating axis 108. The design of said shaft tube 206 ensures that said lint cleaner tube assembly 100 operates efficiently and withstands the operational stresses, thereby enhancing its durability and performance.

In one embodiment, by integrating said slotted shaft 200, said keyless bushing assembly 204, and said shaft tube 206 within said lint cleaner tube assembly 100 ensures that each component functions in harmony to enhance the overall performance of the assembly. Said slotted shaft 200 facilitates the secure attachment of said tube portion 104 to said head assembly 102, while said keyless bushing assembly 204 provides a reliable, backlash-free connection between the shaft and the hubs.

The synergy between these components leads to an increase in operational efficiency, durability, and ease of maintenance of said lint cleaner tube assembly 100, addressing key challenges faced in the cotton ginning industry.

Said lint cleaner tube assembly 100 with said head assembly 102 each having at least said keyless bushing assembly 204, comprises a replaceable head assembly design; wherein, this design feature significantly simplifies the process of repairing and replacing worn or damaged components. The replaceable head assembly, which can be easily detached and reattached to said tube portion 104, eliminates the need for specialized tools or complex procedures, making maintenance more straightforward and cost-effective. By allowing for the replacement of individual parts rather than the entire assembly, said lint cleaner tube assembly 100 not only extends its operational life but also reduces downtime and resource expenditure.

The technical specifications and tolerances of critical components like said keyless bushing assembly 204 and said shaft tube 206 are designed to ensure optimal performance. For instance, said keyless bushing assembly 204 is engineered to accommodate specific shaft diameters, providing a secure fit and precise alignment. Similarly, the dimensions and materials of said shaft tube 206 are chosen to withstand the stresses and strains of continuous operation. These specifications are crucial for maintaining the structural integrity and efficiency of said lint cleaner tube assembly 100, ensuring it meets the high standards required in agricultural machinery.

Diagrams and illustrations, such as FIGS. 1A to 7, are included to provide visual representations of said lint cleaner tube assembly 100 and its components. These figures clearly depict the arrangement and relationship of parts like said head assembly 102, said keyless bushing assembly 204, and said shaft tube 206, aiding in the understanding of their functionalities and interactions. The illustrations are referenced throughout the specification to enhance clarity and comprehension of the described invention.

Potential variations or modifications to the design of said lint cleaner tube assembly 100 are contemplated to accommodate different operational requirements or manufacturing constraints. These variations may include changes in the size, material, or configuration of components like said keyless bushing assembly 204 and said shaft tube 206. Such flexibility ensures that said lint cleaner tube assembly 100 can be adapted to a wide range of applications within the cotton ginning industry, without departing from the core inventive concepts.

In one embodiment, said hub plate 304 is a laser cut component, meticulously designed for accuracy and balance. This precision in manufacturing contributes significantly to the overall balance and stability of said lint cleaner tube assembly 100. The use of laser cutting technology ensures that said hub plate 304 meets exact dimensional specifications, which is critical for maintaining the alignment and efficiency of the assembly.

In a specific embodiment, said slotted shaft 200 includes said splined hub 212, which is engineered to transmit high levels of torque effectively. Said splined hub 212 is designed to handle significant torque loads, such as 10,000 pounds of torque, without compromising the structural integrity of said lint cleaner tube assembly 100. This capability is crucial for the high-performance demands of cotton ginning operations, where consistent and reliable torque transmission is essential for efficient and uninterrupted processing.

PARTS LIST the lint cleaner tube assembly 100,
the head assembly 102,
the second head assembly 102*b*,
the first head assembly 102*a*,
the tube portion 104, the surface wrap 106,
the rotating axis 108,
the slotted shaft 200,
the shaft slot 202,
the keyless bushing assembly 204,
the shaft tube 206,
the distal hub 208,
the proximate hub 210,
the splined hub 212,
the head tubing 300,
the center aperture 302,
the hub plate 304,
the splined portion 500,
the interior end 502,
the exterior end 504,
the splined socket 506,
the plurality of hub fasteners 508,
the section plate line 600,
the method of use 700,
the initial setup step 702,
the alignment check step 704,
the operational start step 706,
the lint cleaning process step 708,
the maintenance check step 710, and
the component replacement step 712.

The following section outlines one preferred embodiment based on the original claims:

The head assembly 102 for use with the lint cleaner tube assembly 100 for use in cotton gins can comprise said head assembly 102 can be configured for installation into the tube portion 104 of said lint cleaner tube assembly 100. Said lint cleaner tube assembly 100 and said head assembly 102 comprise the rotating axis 108. Said tube portion 104 having the surface wrap 106 configured to clean lint. Said head assembly 102 comprise the first head assembly 102*a* and the second head assembly 102*b* which can be configured to be installed into end portions of said tube portion 104. Said head assembly 102 comprising the slotted shaft 200, the keyless bushing assembly 204, the distal hub 208, the proximate hub 210, the splined hub 212. Said slotted shaft 200 having the splined portion 500 at the interior end 502. Said keyless bushing assembly 204 configured to mount said slotted shaft 200 and ensure alignment with the rotating axis 108. Said splined hub 212 configured to engage with said splined portion 500 of said slotted shaft 200. Wherein the splined engagement between said splined hub 212 and said splined portion 500 of said slotted shaft 200 allows for selective attachment and detachment of said slotted shaft 200, facilitating serviceability of said lint cleaner tube assembly 100.

Said surface wrap 106 comprises saw wire configured to remove impurities from cotton fibers.

Said keyless bushing assembly 204 can be configured to self-center said slotted shaft 200 relative to said rotating axis 108.

An distal hub 208 and the proximate hub 210 connected via the shaft tube 206, aligned with said rotating axis 108.

The splined engagement between said splined hub 212 and said splined portion 500 of said slotted shaft 200 can be configured to transmit at least 10,000 pounds of torque.

Each among first head assembly 102*a* and said second head assembly 102*b* further comprises said shaft tube 206 connecting said distal hub 208 and said proximate hub 210, providing structural support and alignment with said rotating axis 108.

Said distal hub 208 and said proximate hub 210 each comprise the hub plate 304 that can be laser-cut for precision and balance.

Said keyless bushing assembly 204 includes the plurality of hub fasteners 508 configured to be loosened to release said slotted shaft 200 for removal.

Said plurality of hub fasteners 508 can be arranged circumferentially around said keyless bushing assembly 204 to evenly distribute clamping force.

The head assembly 102 for the lint cleaner tube assembly 100 in cotton gins can comprise the slotted shaft 200 having the splined portion 500 at one end. the distal hub 208 and the proximate hub 210 connected by the shaft tube 206, aligned with the rotating axis 108. the splined hub 212 within said shaft tube 206, configured to receive and engage said splined portion 500 of said slotted shaft 200. the keyless bushing assembly 204 fitted within said distal hub 208, configured to secure said slotted shaft 200 and ensure its alignment with said rotating axis 108. Wherein the splined engagement between said splined hub 212 and said splined portion 500 of said slotted shaft 200 allows for selective removal and replacement of said slotted shaft 200, improving the serviceability of said lint cleaner tube assembly 100.

Said slotted shaft 200 includes the shaft slot 202 at the exterior end 504 for engagement with a drive mechanism.

Said splined hub 212 can be integrally formed within said shaft tube 206.

Said keyless bushing assembly 204 can be fitted within the center aperture 302 of said distal hub 208.

Said center aperture 302 of said distal hub 208 can be precisely machined to accommodate said keyless bushing assembly 204 with minimal tolerance.

Said splined hub 212 includes the splined socket 506 configured to provide a tight fit with said splined portion 500 of said slotted shaft 200 to ensure balanced rotational movement.

A method for servicing the lint cleaner tube assembly 100 in a cotton gin can comprise loosening the plurality of hub fasteners 508 of the keyless bushing assembly 204 to release the slotted shaft 200, disengaging the splined portion 500 of said slotted shaft 200 from the splined hub 212, removing said slotted shaft 200 from said head assembly among the head assembly 102, inserting a replacement slotted shaft 200 into said head assembly among said head assembly 102, engaging the splined portion 500 of said replacement slotted shaft 200 with said splined hub 212, tightening said plurality of hub fasteners 508 of said keyless bushing assembly 204 to secure said replacement slotted shaft 200 and ensure its alignment with the rotating axis 108 of said lint cleaner tube assembly 100. Wherein, said lint cleaner tube assembly 100 comprising the tube portion 104 with the surface wrap 106 and head assembly 102 each having the slotted shaft 200 with the splined portion 500, the splined hub 212, and the keyless bushing assembly 204.

Checking the alignment of said replacement slotted shaft 200 with said rotating axis 108 after tightening said plurality of hub fasteners 508.

Inspecting the condition of said surface wrap 106 and replacing it if necessary during the servicing process.

Removing said slotted shaft 200 includes sliding it out from the distal hub 208 and the proximate hub 210 along said rotating axis 108.

Cleaning said splined hub 212 and said splined portion 500 of said replacement slotted shaft 200 before engagement to ensure a secure fit.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A lint cleaner tube assembly for use in cotton gins, comprising:

a head assembly is configured for installation into a tube portion of said lint cleaner tube assembly;

said lint cleaner tube assembly and said head assembly comprise a rotating axis;

said tube portion having a surface wrap configured to clean lint;

said head assembly comprising a first head assembly and a second head assembly which are configured to be installed into end portions of said tube portion;

said head assembly comprising a slotted shaft, a keyless bushing assembly, a distal hub, a proximate hub, a splined hub;

said slotted shaft having a splined portion at an interior end;

said keyless bushing assembly configured to mount said slotted shaft and ensure alignment with the rotating axis;

said splined hub configured to engage with said splined portion of said slotted shaft;

wherein the splined engagement between said splined hub and said splined portion of said slotted shaft allows for selective attachment and detachment of said slotted shaft, facilitating serviceability of said lint cleaner tube assembly.

2. The lint cleaner tube assembly of claim 1, wherein said surface wrap comprises saw wire configured to remove impurities from cotton fibers.

3. The lint cleaner tube assembly of claim 1, wherein said keyless bushing assembly is configured to self-center said slotted shaft relative to said rotating axis.

4. The lint cleaner tube assembly of claim 1, wherein a distal hub and the proximate hub connected via a shaft tube, aligned with said rotating axis.

5. The lint cleaner tube assembly of claim 1, wherein the splined engagement between said splined hub and said splined portion of said slotted shaft is configured to transmit at least 10,000 pounds of torque.

6. The lint cleaner tube assembly of claim 1, wherein each among first head assembly and said second head assembly further comprises a shaft tube connecting said distal hub and said proximate hub, providing structural support and alignment with said rotating axis.

7. The lint cleaner tube assembly of claim 1, wherein said distal hub and said proximate hub each comprise a hub plate that is laser-cut for precision and balance.

8. The lint cleaner tube assembly of claim 1, wherein said keyless bushing assembly includes a plurality of hub fasteners configured to be loosened to release said slotted shaft for removal.

9. A head assembly for a lint cleaner tube assembly in cotton gins, comprising:

a slotted shaft having a splined portion at one end;

a distal hub and a proximate hub connected by a shaft tube, aligned with a rotating axis;

a splined hub within said shaft tube, configured to receive and engage said splined portion of said slotted shaft;

a keyless bushing assembly fitted within said distal hub, configured to secure said slotted shaft and ensure its alignment with said rotating axis;

wherein the splined engagement between said splined hub and said splined portion of said slotted shaft allows for selective removal and replacement of said slotted shaft, facilitating serviceability of said lint cleaner tube assembly.

10. The head assembly of claim 9, wherein said slotted shaft includes a shaft slot at an exterior end for engagement with a drive mechanism.

11. The head assembly of claim 9, wherein said splined hub is integrally formed within said shaft tube.

12. The head assembly of claim 9, wherein said keyless bushing assembly is fitted within a center aperture of said distal hub.

13. The head assembly of claim 9, wherein said splined hub includes a splined socket configured to provide a tight fit with said splined portion of said slotted shaft to ensure balanced rotational movement.

14. The head assembly of claim 9, wherein said keyless bushing assembly is configured to self-center said slotted shaft relative to said rotating axis.

15. The head assembly of claim 9, wherein said keyless bushing assembly includes a plurality of hub fasteners configured to be loosened to release said slotted shaft for removal.

16. The head assembly of claim 9, wherein the splined engagement between said splined hub and said splined portion of said slotted shaft is configured to transmit at least 10,000 pounds of torque.

17. A method for servicing a lint cleaner tube assembly in a cotton gin, comprising:

loosening a plurality of hub fasteners of a keyless bushing assembly to release a slotted shaft;

disengaging a splined portion of said slotted shaft from a splined hub;

removing said slotted shaft from a head assembly of said lint cleaner tube assembly;

inserting a replacement slotted shaft having a splined portion into said head assembly;

engaging the splined portion of said replacement slotted shaft with said splined hub;

tightening said plurality of hub fasteners of said keyless bushing assembly to secure said replacement slotted shaft and ensure its alignment with a rotating axis of said lint cleaner tube assembly; wherein said lint cleaner tube assembly comprises a tube portion having a surface wrap, and said head assembly, and said head assembly comprising the slotted shaft with the splined portion, the splined hub, and the keyless bushing assembly.

18. The method of claim 17, further comprising checking the alignment of said replacement slotted shaft with said rotating axis after tightening said plurality of hub fasteners.

19. The method of claim 17, wherein removing said slotted shaft includes sliding it out from a distal hub and a proximate hub along said rotating axis.

20. The method of claim 17, further comprising cleaning said splined hub and said splined portion of said replacement slotted shaft before engagement to ensure a secure fit.

* * * * *